United States Patent [19]

Kawabata et al.

[11] Patent Number: 4,489,547

[45] Date of Patent: Dec. 25, 1984

[54] FIBER CONTROL APPARATUS IN OPEN END SPINNING FRAME

[75] Inventors: Susumu Kawabata, Aichi; Tetsuzo Inoue, Nagoya; Tadanori Kurushima, Kariya; Kazuo Kamiya, Nishio, all of Japan

[73] Assignees: Kabushiki Kaisha Toyoda Jidoshokki Seisakusho; Kabushiki Kaisha Toyota Chuo Kenkyusho, both of Aichi, Japan

[21] Appl. No.: 400,606

[22] Filed: Jul. 22, 1982

[30] Foreign Application Priority Data

Jul. 28, 1981 [JP] Japan ..... 56-117989
Jul. 28, 1981 [JP] Japan ..... 56-117990

[51] Int. Cl.[3] ..... D01H 7/885; D01H 7/882
[52] U.S. Cl. ..... 57/415
[58] Field of Search ..... 57/414, 415, 416

[56] References Cited

U.S. PATENT DOCUMENTS

| | | | |
|---|---|---|---|
| 3,357,168 | 12/1967 | Zlevor et al. | 57/415 |
| 3,624,994 | 12/1971 | Rohlena et al. | 57/415 X |
| 3,659,410 | 5/1972 | Barochovsky et al. | 57/415 X |
| 3,775,957 | 12/1973 | Kihara et al. | 57/415 |
| 4,314,438 | 2/1982 | Miyamoto et al. | 57/415 X |

*Primary Examiner*—Donald Watkins
*Attorney, Agent, or Firm*—Burgess, Ryan & Wayne

[57] ABSTRACT

A fiber control apparatus in an open end spinning frame, which is a spinning rotor provided with a structure capable of producing a rotary stream by which breaking or bending of fibers or formation of floating fibers in a spinning chamber of the rotor can be effectively controlled. This structure is mainly characterized by the arrangement of the exhaust vents formed in the spinning rotor.

5 Claims, 10 Drawing Figures

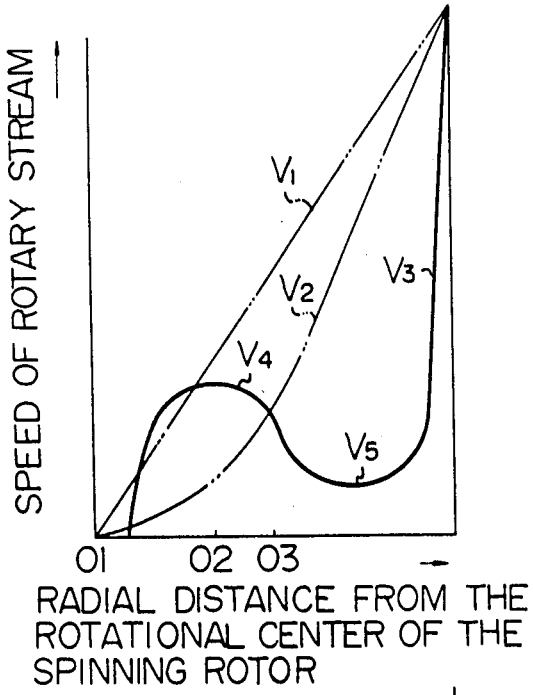
Fig. 3
Fig. 6
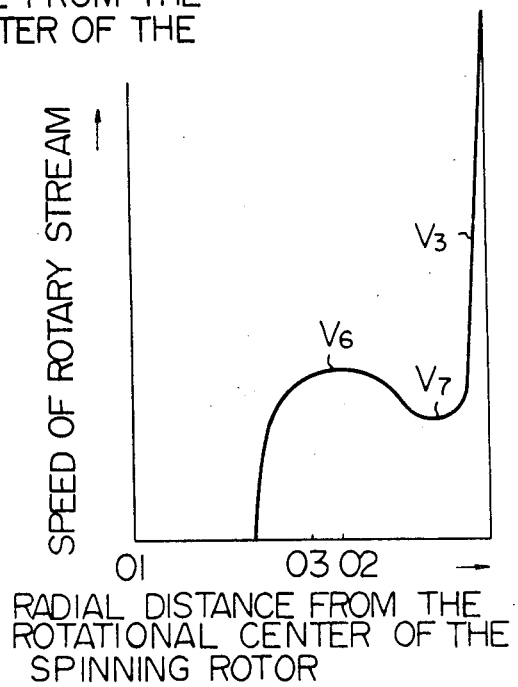

FIBER CONTROL APPARATUS IN OPEN END SPINNING FRAME

BACKGROUND OF THE INVENTION

1. Field of the Invention

The present invention relates to a fiber control apparatus in an open end spinning frame. More particularly, the present invention relates to an improved spinning rotor for use in an open end spinning frame.

2. Description of the Prior Art

As a conventional open end spinning frame, there is known an open end spinning frame of the self-exhaust type in which a plurality of exhaust vents are formed at the bottom of a rotor defining a spinning chamber in radial directions of the rotor. Air is exhausted from the spinning chamber through the exhaust vents by the centrifugal force produced by rotation of the rotor to produce a negative pressure within the spinning chamber. Fibers opened by combing roller disposed within a spinning body are carried from a fiber passage into the spinning chamber by this negative pressure. The fibers are caused to move and are deposited onto the inner circumferential surface of the rotor. Those deposited fibers are displaced to the sliding wall of the rotor by the rotary centrifugal force of the rotor. The fibers are further gathered in the form of a ribbon in a gathering groove. The ribbon of fibers is withdrawn continuously from a yarn guide hole formed in the central portion of a separator to create spun yarns.

In this spinning frame, the factors displacing the fibers to the sliding wall of the rotor are the rotary centrifugal force of the rotor and the rotary stream of accompanying air generated by the viscosity between the sliding wall and air. It has been interpreted that, if we consider the speed variation of this rotary stream in relation to the radial position of the spinning chamber, the speed of the rotary stream with respect to the radial position of the spinning chamber increases toward the sliding wall from the rotary center of the rotor. Such speed variation of the rotary stream is hereinafter refered to as the speed distribution of the rotary stream. It has also been considered that the above-mentioned speed distribution and the pressure thereof are important factors dominating the behavior of fibers in the spinning chamber and, hence, influencing the quality of the resultant yarn.

SUMMARY OF THE INVENTION

The present inventors researched the above-mentioned rotary stream by using a Pitot tube in a conventional self-exhaust type spinning rotor. As the result, the present inventors succeeded in developing a spinning rotor producing a rotary stream capable of controlling the behavior of fibers to a level higher than that attainable by conventional spinning rotors. Specifically, it is a primary object of the present invention to provide a spinning rotor having a structure capable of producing a rotary stream by which breaking or bending of fibers or formation of flying fibers in a spinning chamber of the spinning rotor can be effectively controlled. This object can be attained by a spinning rotor according to the present invention, which is provided with the following structural features.

For the sake of easily understanding the present invention, the following definitions are first made. "Imaginary plane" here means the plane passing through the center of the inside opening of the exhaust vent and perpendicular to the rotation axis of the spinning rotor. "Predetermined radius" means the radius of the spinning rotor along the imaginary plane passing through the center of the inside opening of the exhaust vent. "Predetermined central axis of the exhaust vent" means the line passing through the above-mentioned center of the inside opening of the exhaust vent. The following two conditions are essential to create the structural features of the present invention:

(1) The center of the inside opening of the exhaust vent of the spinning rotor is displaced outward in position from the center of the rotor.

(2) A first imaginary line which is a projection of the predetermined central axis of the exhaust vent on the imaginary plane is inclined to a second imaginary line which is a projection of the predetermined radius toward or opposite to the rotational direction. Such a condition must be satisfied in each exhaust vent. The angle between the above-mentioned two imaginary lines with respect to each exhaust vent is preferably identical.

The results of the present inventors' research showed that one rotary stream is created in the vicinity of the sliding wall of the rotor, another rotary stream is created along with the opening of the exhaust vent, and a low-pressure trough stream portion is created at the position between the above-mentioned two rotary streams. The former rotary stream is hereinafter referred to as the first rotary stream, while the latter rotary stream is hereinafter referred to as the second rotary stream.

It was confirmed that if the above-mentioned first condition is satisfied, the width of the above-mentioned low-pressure trough portion along the radial direction of the spinning rotor can be decreased remarkably, the noticeable reduction speed of the trough stream portion can be prevented, and the static pressure in the area near the central portion of the spinning rotor can be maintained low. Consequently, the creation of floating fibers, bent fibers, and fiber wrapping about the separator of the spinning rotor can be remarkably reduced. Accordingly, it is possible to produce a yarn of better quality than with conventional spinning rotors.

Since the position of the inside opening of the exhaust vent is restricted so as to satisfy the above-mentioned condition (1), if the above-mentioned condition (2) is not satisfied, the axial length of the exhaust vent is shortened. However, in the present invention, the above-mentioned condition (2) is satisfied, consequently, the above-mentioned shortening of the axial length of the exhaust vent can be avoided. Due to this structural feature of the present invention, the resistance on air flowing into the inside opening of the exhaust vent is reduced, whereby the volume of exhaust air can be increased. As the result, the possible creation of floating fibers and bent fibers can be remarkably reduced and the yarn quality can further be improved.

BRIEF DESCRIPTION OF THE DRAWINGS

FIG. 3 is a diagram showing the speed distribution of a rotary stream in the spinning chamber shown in FIG. 1;

FIG. 6 is a diagram showing the speed distribution of a rotary stream in a spinning chamber shown in FIG. 4;

DETAILED DESCRIPTION OF THE PREFERRED EMBODIMENTS

For facilitating understanding of the structure and functional effect of the present invention, the results of analysis made on rotary streams created in a spinning chamber of a conventional self-exhaust type spinning rotor shown in FIG. 1 will first be described.

Figure 1:
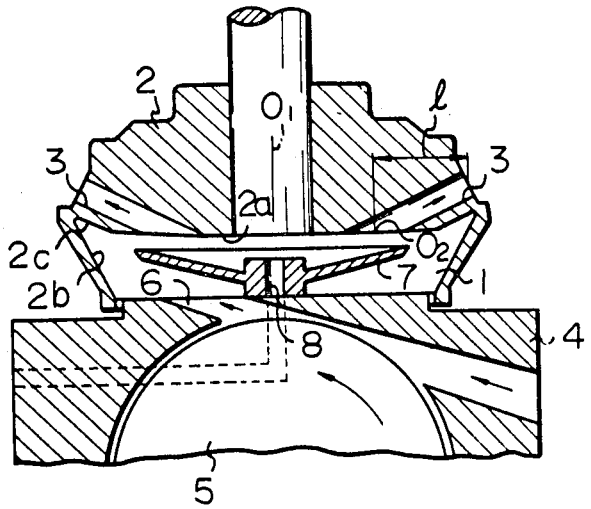
FIG. 1 is a sectional view illustrating a spinning chamber and a surrounding portion thereof in a conventional open end spinning frame.
Figure 2:
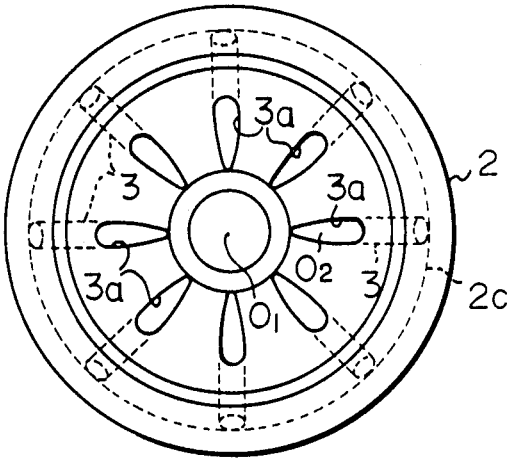
FIG. 2 is a plan view illustrating just the rotor in the spinning frame shown in FIG. 1.

In the self-exhaust type spinning rotor shown in FIG. 1, a spinning chamber 1 comprises a bottom 2*a* of the rotor 2, a sliding wall 2*b* of the rotor 2, and a gathering groove 2*c* for gathering fibers thereon. A plurality of exhaust vents 3 are arranged at the bottom 2*a* in radial directions of the rotor 2. Air is discharged from the spinning chamber 1 through the exhaust vents 3 by the centrifugal force generated by rotation of the rotor 2 so that a negative pressure is created within the spinning chamber 1. Fibers opened by combing roller 5 disposed in a spinning body 4 are carried from a fiber passage 6 into the spinning chamber 1 by this negative pressure. The fibers are caused to move and are deposited onto the inner circumferential surface of the rotor 2. Those deposited fibers are displaced to the sliding wall 2*b* of the rotor 2 by the rotary centrifugal force of the rotor 2. The fibers are further gathered in the form of a ribbon in the gathering groove 2*c*. The ribbon of fibers is withdrawn continuously from a yarn guide hole 8 formed in the central portion of a separator 7 to create spun yarns.

In this spinning frame, the factors displacing the fibers to the sliding wall 2*b* of the rotor 2, are the rotary centrifugal force of the rotor 2 and the rotary stream of accompanying air current generated by the friction between the sliding wall 2*b* and air. It has been considered that the speed of this rotary stream in the spinning chamber increases toward the sliding wall 2*b* from the rotational center O1 of the rotor 2, as indicated by V1 or V2 in FIG. 3.

On the other hand, the results of tests using a Pitot tube, have confirmed that in the spinning chamber 1, as is seen from the speed distribution indicated by the solid line in FIG. 3, wherein the ordinate represents the speed of the rotary stream while the abscissa represents the distance from the rotational center O1 of the spinning rotor, a rotary stream V3 having a considerably high speed, which depends upon an accompanying air current, is formed in the boundary layer in close proximity to the sliding wall 2*b*. In other regions, however, there is only a rotary stream V4 which is formed by the flow of air into the inner opening 3*a* of the exhaust vent 3.

It is known that if the length of the exhaust vent 3 in the direction of the radius is l, as the length l becomes shorter by displacement of the opening of the spinning chamber outward from the center of the rotor, the speed of air discharged from the exhaust vent 3, that is, the exhaust air quantity, is reduced (this phenomenon is explained in detail on page 408 of "Collection of Textile Technique Data" published by the Japanese Spinners' Association, Oct. 1, 1971). Accordingly, in the conventional spinning rotor, a predetermined amount of exhaust air is maintained by forming the center 02 of the opening 3*a* closer to the center O1 of the rotor than to the center of the radius of the spinning chamber. Consequently, the rotary stream V4 formed by the exhaust vent 3 is biassed toward the center O1 of the rotor. The width in the radial direction of the rotor and the depth, representing the pressure drop, of the trough V5 between the rotary streams V3 and V4 are increased, and the speed of the rotary stream of this trough, represented by V5, is decreased.

Therefore, in the conventional spinning rotor, fibers carried into the spinning chamber 1 from the fiber passage 6 of the spinning body 4 are shifted to the low speed trough V5, and the speed of the fibers is reduced and lost. Accordingly, the creation of floating fibers and bent fibers is enhanced. The floating fibers are caught in the turning yarn being run to the yarn guide hole 8, and bending of fibers is frequently created. As the result, the yarn quality is reduced.

From the results of the experimental tests of the conventional spinning frame, it has been found that the static (negative) pressure in the central portion of the rotor is high. Floating fibers are readily stored in this high static pressure portion and fibers are readily wound on the separator 7. Furthermore, these fibers are caught in the yarn being taken to the yarn guide hole 8, thereby reducing the yarn quality.

Based on the view point that the speed distribution of the rotary stream in the spinning chamber 1 is as indicated by V1 or V2, a method has been tried to smoothly guide fibers to the sliding wall 2*b* by carrying the fibers on a high-speed rotary stream. In this method, the top end of the fiber passage 6 is brought as close as possible to the sliding wall 2*b*, which has an accompanying air current, by way of a tube (not shown). However, assembly limitation make it impossible to form the top end of the tube very close to the sliding wall 2*b*. Accordingly, in actual spinning operations, fibers are guided to the position of the above-mentioned trough V5, whereby yarn quality is reduced.

Another modified method has been considered to guide the fibers from the fiber passage 6 toward the position of the rotary stream V4. Also in this case, however, the radial width of the low speed trough V5 is large. While the fibers pass through the position of this trough V5, floating fibers and bent fibers are formed and the above-mentioned problem is not substantially solved.

Figure 4:
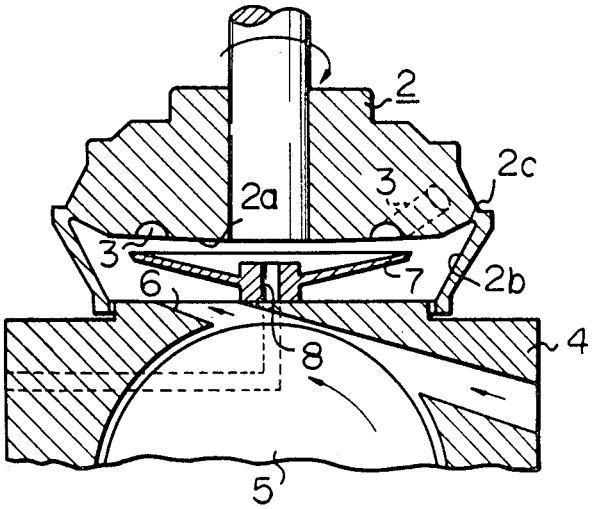
FIG. 4 is a sectional view illustrating a spinning chamber and a surrounding portion thereof for one embodiment of the open end spinning frame according to the present invention.

The structure and functional effect of the self-exhaust type spinning rotor according to the present invention will now be described in detail with reference to FIGS. 4 through 6.

The present invention is different from the above-mentioned conventional spinning frame only in the position and shape of the exhaust vent 3 formed on the rotor 2. Accordingly, members corresponding to the members of the conventional spinning frame shown in FIG. 1 are represented by the same reference numerals.

Figure 5:
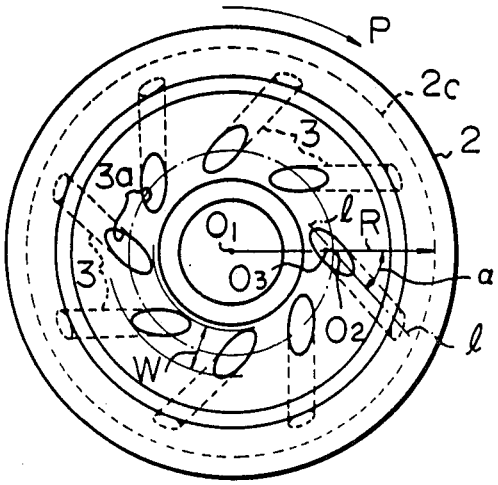
FIG. 5 is a plan view showing just the rotor in the spinning frame shown in FIG. 4.

In this embodiment, as shown in FIG. 5, the center 02 of an opening 3a of an exhaust vent 3 on the side of a spinning chamber 1 is located outward of the center 03 of the distance between the center 01 of the rotor 2 and a gathering groove 2c. The above-mentioned distance corresponds to the maximum inner diameter portion. The radius of the spinning chamber 1 is now represented by R. The angle between the radius passing through the center 02 of an opening 3a and a projection of the central axis l—l of the exhaust vent 3 (on a plane perpendicular to the rotational axis of the spinning chamber 1 and containing the center 02) is defined as the inclination angle $\alpha$ of the exhaust vent 3. When the above-mentioned projection of the central axis l—is inclined in the rotation direction of the rotor 2 (indicated by arrow P in FIG. 5) with respect to the radius R, the inclination angle $\alpha$ is defined as positive, while when the above-mentioned projection of the central axis l—l is inclined backward from the rotation direction P with respect to the radius R, the inclination angle $\alpha$ is defined as negative. The above-mentioned inclination angle $\alpha$ is optionally set within a range of from $+20°$ to $+60°$ or from $-20°$ to $-60°$, preferably from $+40°$ to $+50°$ or from $-40°$ to $-50°$.

The operation of the spinning frame having the above-mentioned structure will now be described.

To effectively place on the rotary stream V6 the fibers carried from the fiber passage 6 to the spinning chamber 1, it is preferable to form an outlet opening of the fiber passage at a position facing the inside opening of the exhaust vent 3.

The speeds of the rotary streams in the spinning chamber 1 were measured by using a Pitot tube. The results are given in the speed distribution diagram of FIG. 6, wherein the ordinate represents the speed of the rotary stream while the abscissa represents the radial distance from the rotational center of the spinning chamber. A comparison of this speed distribution diagram with the speed distribution diagram of the conventional spinning frame of FIG. 3 shows that the rotary stream V6 formed by the exhaust vent 3 in the present embodiment is located outward of the rotary stream V4 in the conventional spinning frame and that the radial width and the speed reduction represented by the depth of the trough V7 between the rotary stream V6 and the rotary stream V3 are smaller than those of the trough V5 in the conventional spinning frame (the speed of rotary stream at the trough V7 is higher than that of the trough V5). Accordingly, the radial width of the rotary stream V6 is increased and the radial width of the rotary stream represented by the trough V7 is reduced in the present embodiment. Therefore, the degree of reduction of the speed of the fibers delivered into the spinning chamber 1 from the fiber passage 6, carried with the rotary streams, and moved to the sliding wall by the centrifugal force is much lower than in the conventional spinning frame. As a result, formation of floating fibers and bent fibers is reduced, the number of fibers caught in the formed yarn is decreased, and the yarn quality is improved.

When the static pressure of the central portion 01 of the rotor in the present embodiment was measured, it was found to be lower than in the conventional spinning frame. Accordingly, formation of floating fibers or winding of fibers on the separator can be reduced and the number of fibers caught in the yarn taken into the yarn guide hole 8 can be decreased, whereby the yarn quality can be remarkably improved.

The conventional spinning frame and the spinning frame of the present embodiment were driven at a rotor speed of 50,000 or 60,000 rpm. The exhaust air quantity and the static pressure of the central portion of the rotor were measured. The resultant data are shown in Tables 1 and 2.

TABLE 1

| Rotor Speed = 50,000 rpm | | |
|---|---|---|
| Inclination angle (ā) of exhaust vent | Exhaust air quantity (l/sec) | Static pressure (mmag) of central portion of rotor |
| −45 | 3.1 | −355 |
| −22.5 | 2.9 | −406 |
| 0 | 2.7 | −456 |
| 22.5 | 2.9 | −424 |
| 45 | 3.1 | −370 |

TABLE 2

| Rotor Speed = 60,000 rpm | | | | |
|---|---|---|---|---|
| Inclination angle (ā) of exhaust vent | Exhaust air quantity (l/sec) | Increased exhaust air quantity (l/sec) | Static Pressure (MMAg) of Central portion of rotor | Increased static pressure (MMAg) of central portion of rotor |
| −45 | 3.7 | 0.6 | −498 | 143 |
| −22.5 | 3.5 | 0.6 | −551 | 145 |
| 0 | 3.1 | 0.4 | −616 | 160 |
| 22.5 | 3.4 | 0.5 | −571 | 147 |
| 45 | 3.7 | 0.6 | −508 | 138 |

In the above tables the symbol l indicates liters, the symbol Ag indicates water, and the symbol mm indicates millimeters.

From the results shown in Table 1 and 2, the following facts can be seen. The exhaust air quantity is larger in the embodiment of the present invention, where the inclination angle $\alpha$ of the exhaust vent is $\pm 22.5°$ or $\pm 45°$, than in the conventional spinning frame, where the inclination angle $\alpha$ is 0°. Furthermore, the static pressure of the central portion of the rotor is reduced in the present invention. The increase of the exhaust air quantity by the increase of the rotor speed of the spinning rotor is larger in the present embodiment, and the increase of the static pressure by the increase of the rotor speed of the spinning rotor is smaller in the present embodiment. Accordingly, it will readily be understood that according to the present invention, a spinning operation can be carried out under better conditions than in the conventional spinning frame, consequently, yarn quality can be improved.

Examination of the qualities of two yarns obtained by a conventional spinning frame and the spinning frame of the above-mentioned embodiment of the present invention at a spinning rotor speed of 60,000 rpm and a winding speed of 125 m/min (forming cotton spun yarn having a count number of 6 s and a twist number of 480 T/m) showed that the yarn obtained according to the present invention was superior in the lea strength, U%, nep number, and substantial twist number, as shown in Table 3.

TABLE 3

| Rotor Speed of 60,000 rpm | | |
|---|---|---|
| | Conventional technique | Present invention |
| Lea strength, kg | 148 | 156 |
| U % | 10.7 | 10.2 |
| Nep number per 1000 m | 21 | 12 |

TABLE 3-continued

| Rotor Speed of 60,000 rpm | Conventional technique | Present invention |
|---|---|---|
| Cubstantial twist number, T/m | 415 | 465 |

Figure 7:
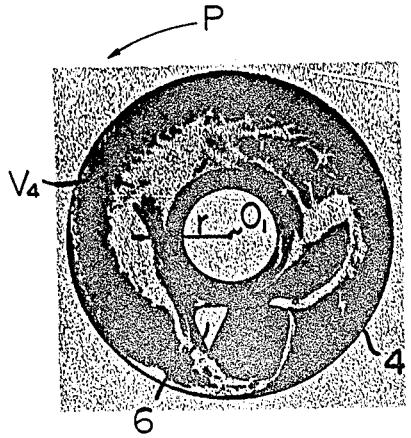
FIGS. 7 and 8 are photographic prints indicating the results of visual experiments which were carried out to confirm the existence of the rotary streams in the spinning chamber for a conventional spinning rotor and a spinning rotor according to the present invention, respectively.
Figure 8:
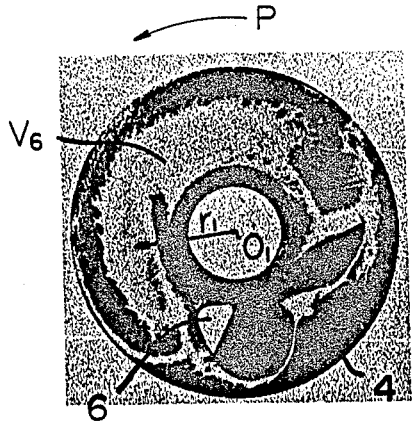

The rotary streams V4 and V6 formed in the conventional spinning frame and the spinning frame of the present invention can be confirmed by the flow visualization method in which titanium oxide is dissolved in an oil, the solution is coated on the top face of the spinning body, and the moving state of the solution is observed while rotating the rotor 2. According to this method, with the conventional technique, as shown in FIG. 7, a white annular portion is formed where the solution gathers at a position corresponding to the opening 3a of the exhaust vent 3. This white annular portion corresponds to the rotary stream V4. The radius r from the center 01 of the rotor is small. With the present invention, as shown in FIG. 8, the radius r1 of the rotary stream V6, indicated by the white annular portion, from the center 01 of the rotor is larger than the radius r in the conventional spinning frame.

As another conventional rotor, there is known a rotor in which an exhaust vent 3 is formed on a gathering groove 2c to perform air-exhaust effectively and to smoothly suck fibers into the gathering groove 2c. In this rotor, however, good quality fibers are readily caused to fly out from the exhaust vent and the two ends of fibers can be introduced into two different exhaust vents, i.e., "bridging", with the result that it becomes difficult to obtain spun yarns having a good quality. Therefore, the opening 3a should be formed on the bottom 2a of the rotor 2.

In addition to the foregoing embodiment, the present invention includes the following embodiments.

Figure 9:
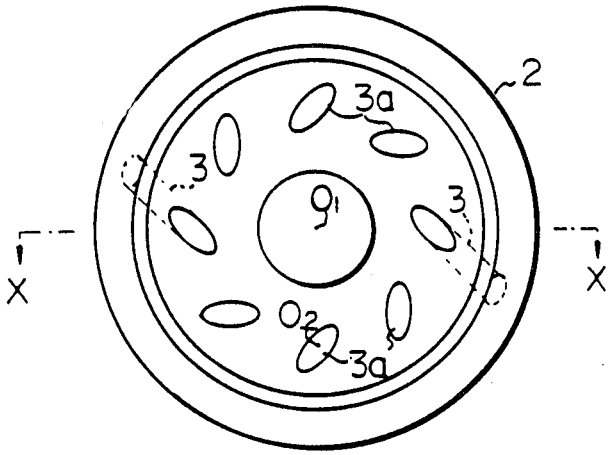
FIG. 9 is a plan view illustrating another embodiment of the rotor of the present invention.
Figure 10:
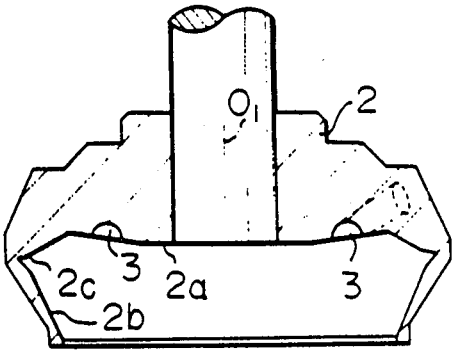
FIG. 10 is a view showing the section taken along the line X—X in FIG. 9.

(1) As shown in FIGS. 9 and 10, the gathering groove 2c of the rotor 2 is formed at a position raised from the surface of the bottom 2a, and the center 02 of the opening 3a of the exhaust vent 3 is located more outward than in the above-mentioned first embodiment.

Results of experiments have confirmed that, as shown in Table 4, also in this embodiment, the exhaust air quantity is larger than in the conventional technique, the static pressure is lower than in the conventional technique, and the yarn quality is improved as in Table 3 over the quality of the yarn obtained according to the conventional technique.

TABLE 4

| Inclination angle (ß) of exhaust vent | Exhaust air quantity (l/sec) | Static pressure (mmAg) of central portion of rotor |
|---|---|---|
| −60 | 3.3 | −409 |
| −45 | 3.2 | −458 |
| −22.5 | 3.0 | −513 |
| 0 | 2.9 | −565 |
| 22.5 | 3.0 | −525 |
| 45 | 3.1 | −474 |
| 60 | 3.4 | −418 |

(2) The position of the fiber passage 6 is set so that fibers coming from the fiber passage 6 are carried on the rotary stream V6. In this embodiment, also the shape of the separator 7 should be changed. The fibers carried on the rotary stream V6 receive a large centrifugal force while they are violently turned. The fibers smoothly pass through the portion corresponding to the trough V7 in FIG. 6 and are guided to the sliding wall 2b. Accordingly, in this embodiment, formation of floating fibers or bent fibers can be much more reduced than in the case where fibers are directly introduced to the portion corresponding to the trough V7 in FIG. 6. The yarn quality can therefore further be improved over the quality of the yarn obtained in the above-mentioned first embodiment.

As will be apparent from the foregoing description, according to the present invention, by intentionally fixing the center of the opening of the exhaust vent on the bottom of the rotor outward of the central portion of the distance between the rotational center of the rotor and the fiber gathering groove, that is, the central portion of the maximum radius of the spinning chamber, the radial width and the slow down of the air stream represented by the depth of the trough between the rotary stream produced in the vicinity of the sliding wall of the rotor and the rotary stream produced by air flowing into the opening of the exhaust vent can be reduced, and, simultaneously, the static pressure of the central portion of the rotor can be reduced, whereby formation of floating fibers and bent fibers in the spinning chamber or winding of fibers on the separator can effectively be controlled and reduced and the yarn quality can be remarkably improved.

These effects can be enhanced if the angle $\alpha$, between the radius passing through the center of the opening and the projection of the central axis of the exhaust vent on a plane perpendicular to the rotational axis of the spinning chamber and containing the above-mentioned center of the opening, is inclined at 20° to 60° C. in the direction of rotation of the rotor or the direction opposite thereto.

We claim:

1. A spinning rotor for an open end spinning frame, said rotor having a central axis of rotation and comprising:

a bottom surface having a substantially flat major central position and an upwardly extending frustoconical peripheral portion;

a frustoconical wall extending downwardly from the periphery of said frustoconical peripheral portion of said bottom surface to form a fiber gathering groove at the junction of said frustroconical wall and frustoconical peripheral surface; and at least one upwardly and outwardly extending exhaust vent having a central axis and an inlet in the major central portion of said bottom surface below said frustoconical peripheral portion thereof for discharging air from a spinning chamber partially defined by said bottom surface and frustoconical wall, by a centrifugal force produced by rotation of the rotor so that a negative air pressure is created within said spinning chamber and opened fibers are carried into said spinning chamber via a fiber passage by said negative air pressure, there being an acute angle between (i) a projection of the central axis of said exhaust vent on a plane perpendicular to said axis of rotation and including said inlet, and (ii) a radius extending from said axis of rotation to the center of said inlet, said projection being disposed on a side of said radius extending in the direction of rotation of said rotor or the direction opposite thereto, said exhaust vent inlet being located radially outward of a point midway between the axis of rotation of said rotor and said fiber gathering groove.

2. The spinning rotor according to claim 1, wherein said acute angle extends in the direction of rotation of said rotor.

3. The spinning rotor according to claim 1, wherein said acute angle is in the range of 20 degrees to 60 degrees.

4. The spinning rotor according to claim 3, wherein said acute angle is in the range of 50 degrees to 60 degrees.

5. The spinning rotor according to claim 1, wherein said fiber passage has an outlet disposed at a position facing a given rotational position of said exhaust vent inlet, so that fibers carried through said fiber passage into said spinning chamber are directed toward a rotary stream formed at a position corresponding to that of said exhaust vent inlet.

* * * * *